US005950426A

United States Patent [19]

Morita et al.

[11] Patent Number: 5,950,426

[45] Date of Patent: Sep. 14, 1999

[54] HYDRAULIC CIRCUIT FOR HYDRAULIC MACHINE

[75] Inventors: Izuru Morita; Ryuzo Maeda; Toshiyuki Shigeta, all of Setagaya-ku, Japan

[73] Assignee: Shin Caterpillar Mitsubishi Ltd., Tokyo, Japan

[21] Appl. No.: 08/930,410

[22] PCT Filed: Jan. 29, 1997

[86] PCT No.: PCT/JP97/00191

§ 371 Date: Oct. 28, 1997

§ 102(e) Date: Oct. 28, 1997

[87] PCT Pub. No.: WO97/28318

PCT Pub. Date: Aug. 7, 1997

[30] Foreign Application Priority Data

Feb. 1, 1996 [JP] Japan ..... 8-038877

[51] Int. Cl.[6] ..... F16D 31/02

[52] U.S. Cl. ..... 60/399; 60/429; 60/499; 91/448

[58] Field of Search ..... 60/399, 429, 494

[56] References Cited

U.S. PATENT DOCUMENTS

| | | | |
|---|---|---|---|
| 4,119,016 | 10/1978 | Pfeil et al. | 60/494 |
| 4,402,339 | 9/1983 | Owens | 60/494 |
| 4,570,672 | 2/1986 | Wilke | 91/448 |
| 4,730,543 | 3/1988 | Holmes | 91/448 |
| 5,083,428 | 1/1992 | Kubomoto et al. | 60/429 |
| 5,469,703 | 11/1995 | Ericsson et al. | 60/399 |

FOREIGN PATENT DOCUMENTS 141403 5/1993 Japan .

*Primary Examiner*—F. Daniel Lopez
*Attorney, Agent, or Firm*—Oliff & Berridge, PLC

[57] ABSTRACT

A hydraulic circuit enables a plurality of hydraulic actuators to be locked or unlocked at the same time no matter whether control valves controlling pressurized oil feed to the hydraulic actuators are pilot-controlled or not. To this end, the circuit is provided with oil lines leading from hydraulic pumps to an oil reservoir without passing through the control valves and with first and second selector valves 20 and 24 opening or closing the oil lines.

6 Claims, 8 Drawing Sheets

HYDRAULIC CIRCUIT FOR HYDRAULIC MACHINE

BACKGROUND OF THE INVENTION

1. Technical Field

The present invention relates to a hydraulic circuit for hydraulic equipment used in various types of construction work, such as hydraulic shovels.

2. Background Art

Some hydraulic equipment for construction work is arranged to control pressurized oil fed to a plurality of hydraulic actuators, using their corresponding control valves. Switching means for such control valves include pilot-operated means, which use pilot pressurized oil fed to control valves, and other means, for example, manual, mechanical, and electrical means.

Since control equipment for such means, including operating levers, is sometimes operated unexpectedly against the operator's will, a safety locking mechanism needs to be installed in hydraulic equipment to prevent hydraulic actuators from operating accidentally. To form such a safety locking mechanism, conventional pilot-operated means have safety valves installed in pilot oil lines between pilot pressurized oil sources and pilot valves, switching pilot pressurized oil feed to control valves. When a safety valve is closed, pilot pressurized oil is not fed to a control valve, so that it cannot be switched to their pressurized oil feed position. However, when the operator unlocks the safety lever in the operator's seat, for example, the safety valve opens, thus allowing pilot pressurized oil to be fed to the control valve. The other means mentioned above have mechanical locking devices attached to the control equipment, by use of which devices the operator locks or unlocks the control equipment.

Locking mechanisms for switching means other than pilot-operated means have a problem of a locking device being required by the individual control equipment. What is worse, operating such a locking device is troublesome because it needs to be operated every time locking or unlocking is done. To solve these problems, the idea has been proposed that locking devices for switching means are interlocked so that locking and unlocking can be done using switches. Mechanisms based on the idea, however, also need locking devices for their individual control equipment, which consist of many parts and are complex in structure and costly. This is a problem which the present invention is intended to solve.

Another problem with conventional switching means is that safety valves for pilot-operated means and those for other means use different locking mechanisms.

SUMMARY OF THE INVENTION

Taking into account the foregoing, the present invention has been made to solve the problems described above. According to a first aspect of the present invention, a hydraulic circuit for hydraulic equipment, which circuit is arranged so that pressurized oil feed to a plurality of hydraulic actuators is controlled using their corresponding control valves, wherein there are provided an unloading oil line that leads from a pressurized oil source, which feeds pressurized oil to said plurality of hydraulic actuators, to an oil reservoir without passing through the control valves and an unloading oil line selector valve that opens or closes the unloading oil line. The hydraulic circuit enables pressurized oil feed to the hydraulic actuators to be stopped by opening the unloading oil line, so that the hydraulic actuators are locked at the same time. This eliminates the need for troublesome locking of individual hydraulic actuators.

According to a second aspect of the present invention, a hydraulic circuit for hydraulic equipment, which circuit is arranged so that pressurized oil feed to a plurality of hydraulic actuators is controlled using their corresponding control valves and uses both pilot-controlled means, relying on pilot pressurized oil fed to the control valves to switch them, and other means as valve switching means, wherein there are provided an unloading oil line that leads from a pressurized oil source feeding pressurized oil to said hydraulic actuators to an oil reservoir without passing through the control valves of the at least other means and an unloading oil line selector valve that opens or closes the unloading oil line, and furthermore there is provided a branch pilot oil line between a supply source of said pilot pressurized oil and a pilot valve switching pilot pressurized oil into said control valve, said unloading oil line selector valve is arranged to switch from open position to closed position by feeding pilot pressurized oil through the branch pilot oil line and a pilot oil line selector valve for opening or closing said pilot oil line is placed in a pilot oil line between said pilot pressurized oil source and a branch point for opening or closing said pilot oil line. The hydraulic circuit enables the hydraulic actuators to be locked at the same time as in the case of the first aspect of the present invention. Moreover, since pilot pressurized oil switches the unloading oil line selector valve, only stopping pilot pressurized oil feed causes the hydraulic actuators to be locked, and the hydraulic circuit arrangement is simple.

According to the second aspect of the present invention again, the control valves can be prevented from being switched to the pressurized oil feed position by shutting off pilot pressurized oil fed to the pilot valves and unloading oil line selector valve when the pilot oil line selector valve is closed.

According to the first and second aspects of the present invention, a hydraulic circuit for hydraulic equipment according to the present invention, wherein there are provided an additional hydraulic actuator besides said plurality of hydraulic actuators, a second pressurized oil source that feeds pressurized oil to the additional hydraulic actuator, and a second control valve that controls pressurized oil feed to the additional hydraulic actuator, and the unloading oil line selector valve can be switched not only to open and closed positions which cause the unloading oil line to open and close but to a connection position which causes a valve path feeding to the second control valve pressurized oil flowing through the oil line from the pressurized oil source for the plurality of hydraulic actuators to the unloading oil line selector valve to open to join together pressurized oil from said oil line and pressurized oil from the second pressurized oil source. The unloading oil line selector valve not only opens or closes the unloading oil line but joins together pressurized oil from one of the pressurized oil sources and pressurized oil from the other. That is, the unloading oil line selector valve has two functions used for hydraulic circuits, thus simplifying hydraulic circuit arrangement.

In the hydraulic circuit, the oil line from the pressurized oil source for the plurality of hydraulic actuators to the unloading oil line selector valve is formed so that the oil line passes through a neutral control valve which does not allow pressurized oil to be fed to its corresponding hydraulic actuator. This is favorable because pressurized oil can be fed to the additional hydraulic actuator when pressurized oil is not fed to the plurality of hydraulic actuators.

DETAILED DESCRIPTION OF THE PREFERRED EMBODIMENTS

Figure 1:
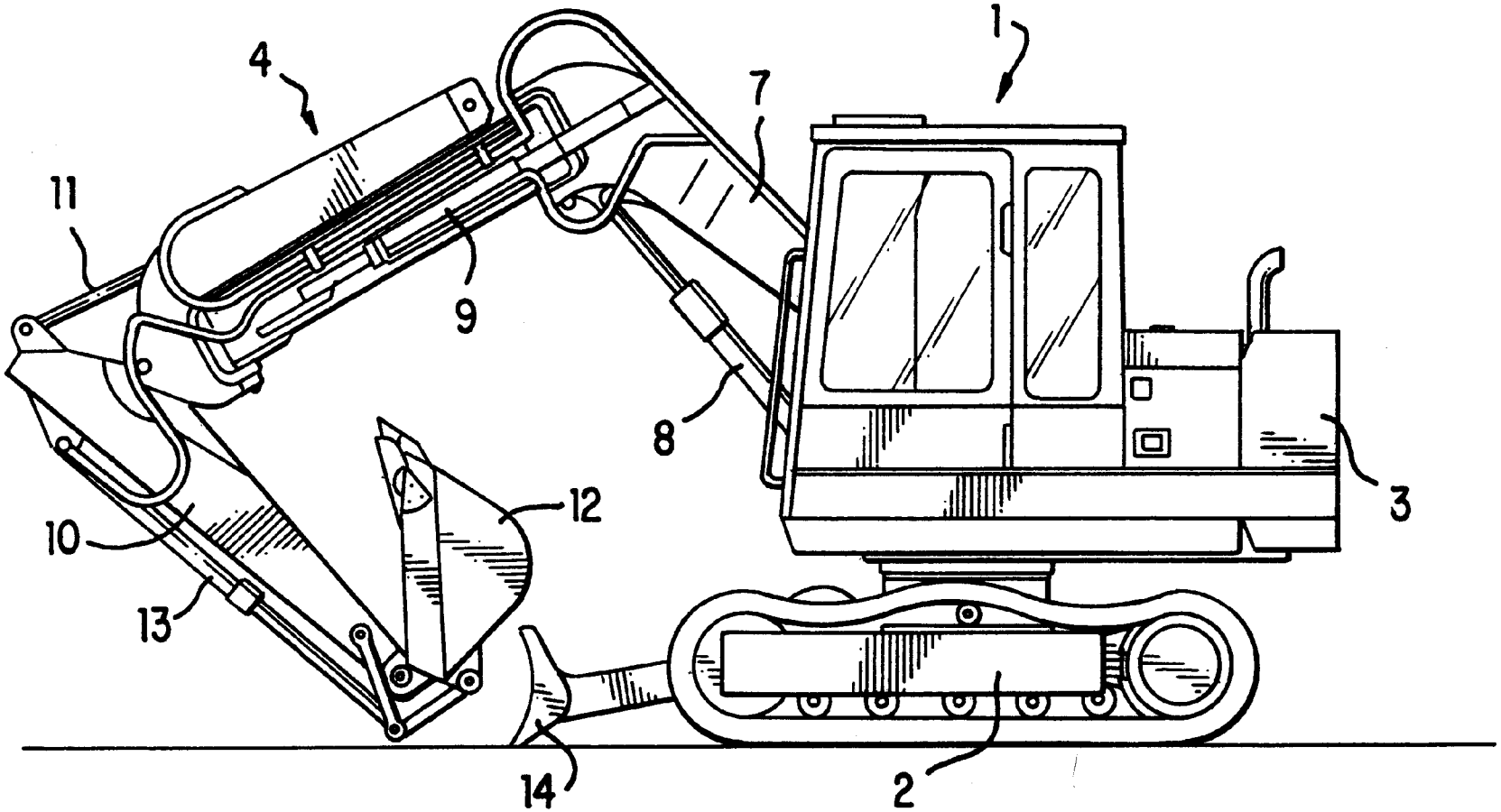
FIG. 1 is a side view of a hydraulic shovel.

Referring now to the drawings, an embodiment of the present invention is described below. In the drawings, the numeral 1 indicates a hydraulic shovel. The hydraulic shovel 1 comprises crawler type lower structure 2; an upper structure 3, pivoted over the lower structure 2 so that it rotates freely; and a working attachment 4, installed in front of the upper structure 3. The hydraulic shovel 1 also has right and left travel motors 5R and 5L for traveling the lower structure 2; a swing motor 6 for swinging the upper structure 3; and several actuators including a boom swing cylinder 9, shifting a boom 7 from side to side; an arm cylinder 11, moving an arm 10 back and forth; a bucket cylinder 13, moving a bucket 12 back and forth; and a blade cylinder 15, moving a blade 14 up and down. These hydraulic actuators are arranged so that they operate on pressurized oil from hydraulic pumps P, powered by an engine E, or a power source, installed in the upper structure 3.

Referring now to the hydraulic circuits in FIGS. 2, 3, and 4, pressurized oil feed to the hydraulic actuators above is described below. The embodiment has two hydraulic pumps P, that is, first and second hydraulic pumps P1 and P2. These pumps P1 and P2 are arranged so that pressurized oil from them is fed to the actuators through a control valve unit 16, controlling pressurized oil feed to the actuators.

The control valve unit 16 incorporates various valves including boom swing, blade, swing, arm, right travel, left travel, boom, and bucket control valves 17, 18, 19, 22, 23R, 23L, 25, and 26, a control valve 21 for a replacement attachment (for example, an attachment removably attached to a hydraulic shovel, such as a breaker, not shown), first and second selector valves 20 and 24, and relief valves 27, 28, and 29. The control valve unit also has various ports formed therein, including first and second pump ports PA and PB, connected to the first hydraulic pump P1; a third pump port PC, connected to the second hydraulic pump P2; first and second reservoir ports TA and TB, connected to an oil reservoir T; input/output ports 9A, 9B, 15A, 15B, 6A, 6B, 11A, 11B, 5RA, 5RB, 5LA, 5LB, 8A, 8B, 13A, 13B, connected to the boom swing cylinder 9, blade cylinder 15, swing motor 6, arm cylinder 11, right travel motor 5R, left travel motor 5L, boom cylinder 8, and bucket cylinder 13; and input/output ports 21A and 21B (power takeouts PTO), detachably connected to a replacement attachment (the ports 21A and 21B are closed when no replacement attachment is installed).

Using operating levers, the control valves 17, 18, 19, 21, 22, 23R, 23L, 25, and 26 in the control valve unit 16 can be switched from a neutral position X, which allows no pressurized oil to be fed from the hydraulic pumps P1 and P2 to the hydraulic actuators, to a pressurized oil feed position Y, which allows pressurized oil to be fed to one of the input/output ports of a corresponding hydraulic actuator, or a pressurized oil feed position Z, which allows pressurized oil to be fed to the other (a blade control valve 18 can be placed in a blade own-weight descent position W, as well as the positions X, Y, and Z, which does not allow pressurized oil to be fed, but the blade cylinder 15 to be contracted by the own weight of the blade 14). The swing, arm, boom, and bucket control valves 19, 22, 25, and 26 are arranged so that they are pilot-operated; that is, feeding pilot pressurized oil from swing, arm, boom, and bucket pilot valves 32, 33, 34, and 35 to pilot ports 19*a*, 19*b*, 22*a*, 22*b*, 25*a*, 25*b*, 26*a*, and 26*b*, formed in the control valves 19, 22, 25, and 26, by using operating levers 30 and 31 causes the control valves to switch from the neutral position X to the pressurized oil feed position Y or Z. The boom swing, blade, replacement attachment, right travel, and left travel control valves 17, 18, 21, 23L, and 23R are arranged so that they are manually operated; that is, using operating levers 17*a*, 18*a*, 21*a*, 23La, and 23Ra, directly linked through linkages with the control valves, causes them to switch from the neutral position X to the pressurized oil feed position Y or Z.

As described above, the embodiment uses pilot-operated or manually operated control valves. The present invention, however, is not limited to control valves of these two types and can apply to such control valves as operated mechanically or electrically.

Below is briefly described a basic hydraulic circuit formed in the control valve unit 16. A first pump center bypass oil line D passes through the first pump port PA and then the second selector valve 24 and connects to the left travel control valve 23L placed downstream, which is in the pressurized oil feed position Y or Z. The oil line D also passes through the left travel control valve 23L, which is in the neutral position X, the boom control valve 25, and the bucket control valve 26 and reaches a reservoir oil line F, connecting to the first reservoir port TA or the second reservoir port TB.

A first pump parallel oil line G passes through the first pump port PA, the second selector valve 24, a restrictor 36, and a check valve 37 and connects to the boom control valve 25 and the bucket control valve 26, which are in the pressurized oil feed position Y or Z. The oil line G is installed in parallel with the first pump center bypass oil line D. Pressurized oil passing through the left travel control valve 23L and boom control valve 25 along the first pump center bypass oil line D, flows through check valves 38 and 39 into the first pump parallel oil line G.

A second pump center bypass oil line H passes through the second pump port PB and then the second selector valve 24 and connects to the right travel control valve 23R placed downstream, which is in the pressurized oil feed position Y or Z. The oil line H also passes through the right travel control valve 23R, which is in the neutral position X, the arm control valve 22, and the replacement attachment control valve 21 and reaches the reservoir oil line F.

A second pump parallel oil line J passes through the second pump port PB, the second selector valve 24 at a junction described below, a restrictor 40, and a check valve 41 and connects to the arm control valve 22, which is in the pressurized oil feed position Y or Z, and the replacement attachment control valve 21. The oil line J is installed in parallel with the second pump center bypass oil line H. Pressurized oil travel along the second pump center bypass oil line H through the right travel control valve 23R and arm control valve 22, which are in the neutral position X, flows through check valves 42 and 43 into the second pump parallel oil line J.

A third pump center bypass oil line K passes through the third pump port PC and connects to the boom swing control valve 17, which is in the pressurized oil feed position Y or Z. The oil line K also passes through the boom swing control valve 17, blade control valve 18, swing control valve 19, and first selector valve 20, all of which are in the neutral position X, and reaches the reservoir oil line F.

A third pump parallel oil line L, branching from the third center bypass oil line K upstream of the control valves 17, 18, and 19, connects to the blade control valve 18 and swing control valve 19, which are in the pressurized oil feed position Y or Z, and the first selector valve 20 in the neutral position X, which valve is described later. The oil line L is installed in parallel with the third pump center bypass oil line K.

The left travel control valve 23L is arranged as described below. When in the neutral position X, the control valve 23L allows pressurized oil passing through the first pump center bypass oil line D to flow to the side of the boom control valve 25 and pressurized oil passing through a fourth branch pilot oil line M, described later, to flow to the side of the boom control valve 25 and reservoir oil line F. When in the pressurized oil feed position Y or Z, on the other hand, the control valve 23L allows pressurized oil input from the first pump center bypass oil line D to be output to the left travel input/output ports 5LA and 5LB and pressurized oil passing through the fourth branch pilot oil line M to flow to the side of the boom control valve 25.

The boom control valve 25 is arranged as described below. When in the neutral position X, the control valve 25 allows pressurized oil passing along the first pump center bypass oil line D through the left travel control valve 23L and pilot pressurized oil passing through the fourth branch pilot oil line M to flow to the side of the bucket control valve 26. When in the pressurized oil feed position Y or Z, the control valve 25 allows pressurized oil input through a check valve 44 from the first pump parallel oil line G to be output to the boom input/output ports 8A and 8B.

The bucket control valve 26 is arranged as described below. When in the neutral position X, the control valve 26 allows pressurized oil travel along the first center bypass oil line D through the boom control valve 25 to flow into the reservoir oil line F and pilot pressurized oil running along the fourth branch pilot oil line M through the left travel control valve 23L and boom control valve 25 to flow to the side of the arm control valve 22. When in the pressurized oil feed position Y or Z, on the other hand, the control valve 26 allows pressurized oil input through a check valve 45 from the first pump parallel oil line G to be output to the bucket input/output ports 13A and 13B.

The right travel control valve 23R is arranged as described below. When in the neutral position X, the control valve 23R allows pressurized oil passing through the second pump center bypass oil line H to flow to the side of the arm control valve 22. When in the pressurized oil feed position Y or Z, on the other hand, the control valve 23R allows pressurized oil input from the second pump center bypass oil line H to be output to the right travel input/output ports 5RA and 5RB.

The arm control valve 22 is arranged as described below. When in the neutral position X, the control valve 22 allows pressurized oil passing along the second pump center bypass oil line H through the right travel control valve 23R to flow to the side of the replacement attachment control valve 21 and pilot pressurized oil travel along the fourth branch pilot oil line M through the left travel control valve 23L, boom control valve 25, and bucket control valve 26 to flow into the reservoir oil line F. When in the pressurized oil feed position Y or Z, on the other hand, the control valve 22 allows pressurized oil input through a check valve 46 from the second pump parallel oil line J to be output to the arm input/output ports 11A and 11B.

The replacement attachment control valve 21 is arranged as described below. When in the neutral position X, the control valve 21 allows pressurized oil traveling along the second pump center bypass oil line H through the right travel control valve 23R and arm control valve 22 to flow into the reservoir oil line F. When in the pressurized oil feed position Y or Z, on the other hand, the control valve 21 allows pressurized oil input through a check valve 47 from the second pump parallel line J to be output to the replacement attachment input/output ports 21A and 21B.

The boom swing control valve 17 is arranged as described below. When in the neutral position X, the control valve 17 allows pressurized oil passing through the third pump center bypass oil line K to flow to the side of the blade control valve 18. When in the pressurized oil feed position Y or Z, on the other hand, the control valve 17 allows pressurized oil input through a check valve 48 from the third pump center bypass oil line K to be output to the boom swing input/output ports 9A and 9B.

The blade control valve 18 is arranged as described below. When in the neutral position X or blade own-weight descent position W, the control valve 18 allows pressurized oil travel along the third pump center bypass oil line K through the boom swing control valve 17 to flow to the side of the swing control valve 19. When in the pressurized oil feed position Y or Z, on the other hand, the control valve 17 allows pressurized oil input through a check valve 49 from the third pump parallel oil line L to be output to the blade input/output ports 15A and 15B.

The swing control valve 19 is arranged as described below. When in the neutral position X, the control valve 19 allows pressurized oil traveling along the third pump center bypass oil line K through the boom swing control valve 17 and the blade control valve 18 to flow to the side of the first selector valve 20. When in the pressurized oil feed position Y or Z, on the other hand, the control valve 19 allows pressurized oil input through a check valve 50 from the third pump parallel oil line L to be output to the swing input/output ports 6A and 6B.

Figure 5:
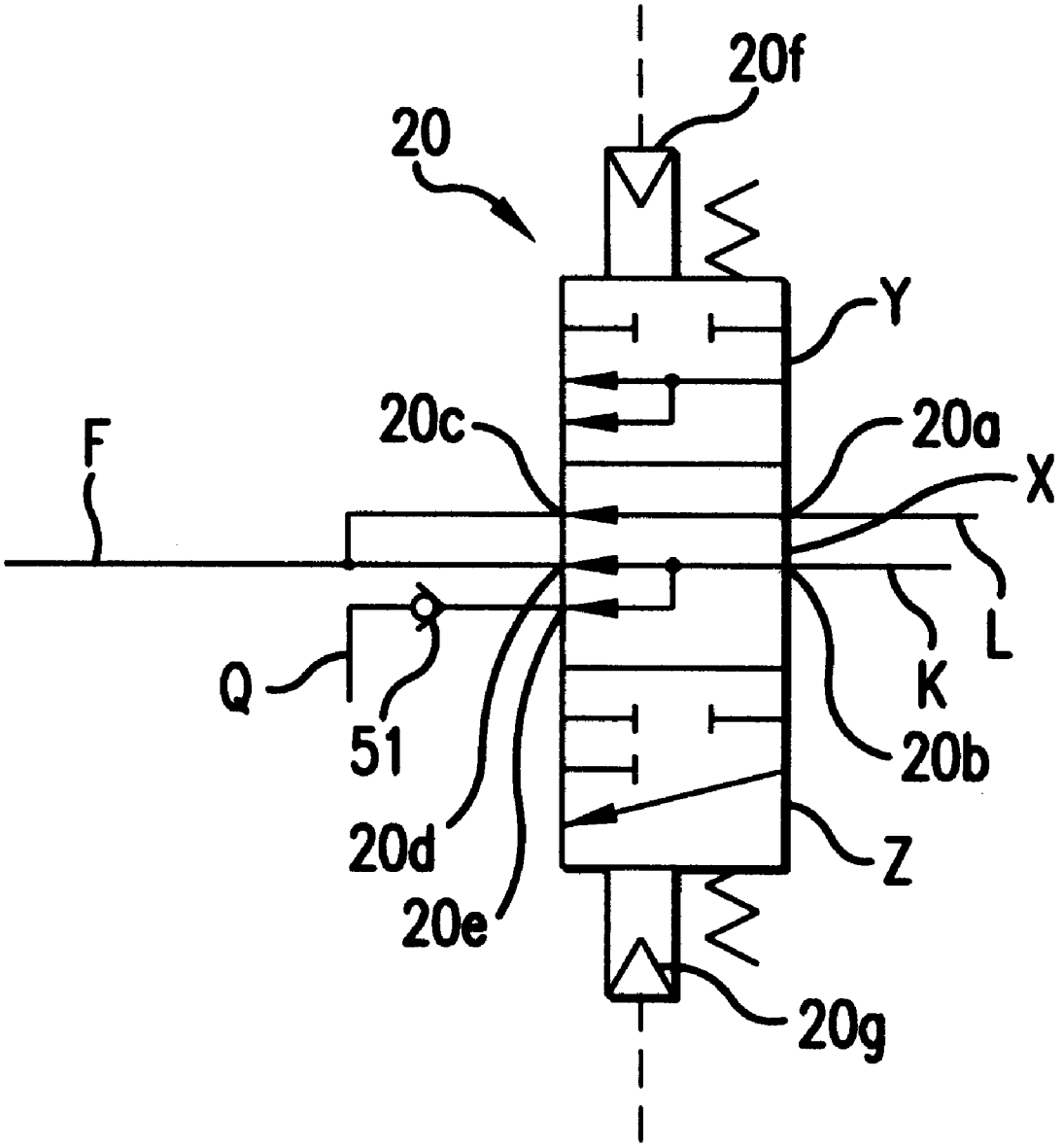
FIG. 5 is an enlarged view illustrating the connections of a first selector valve.
Figure 6:
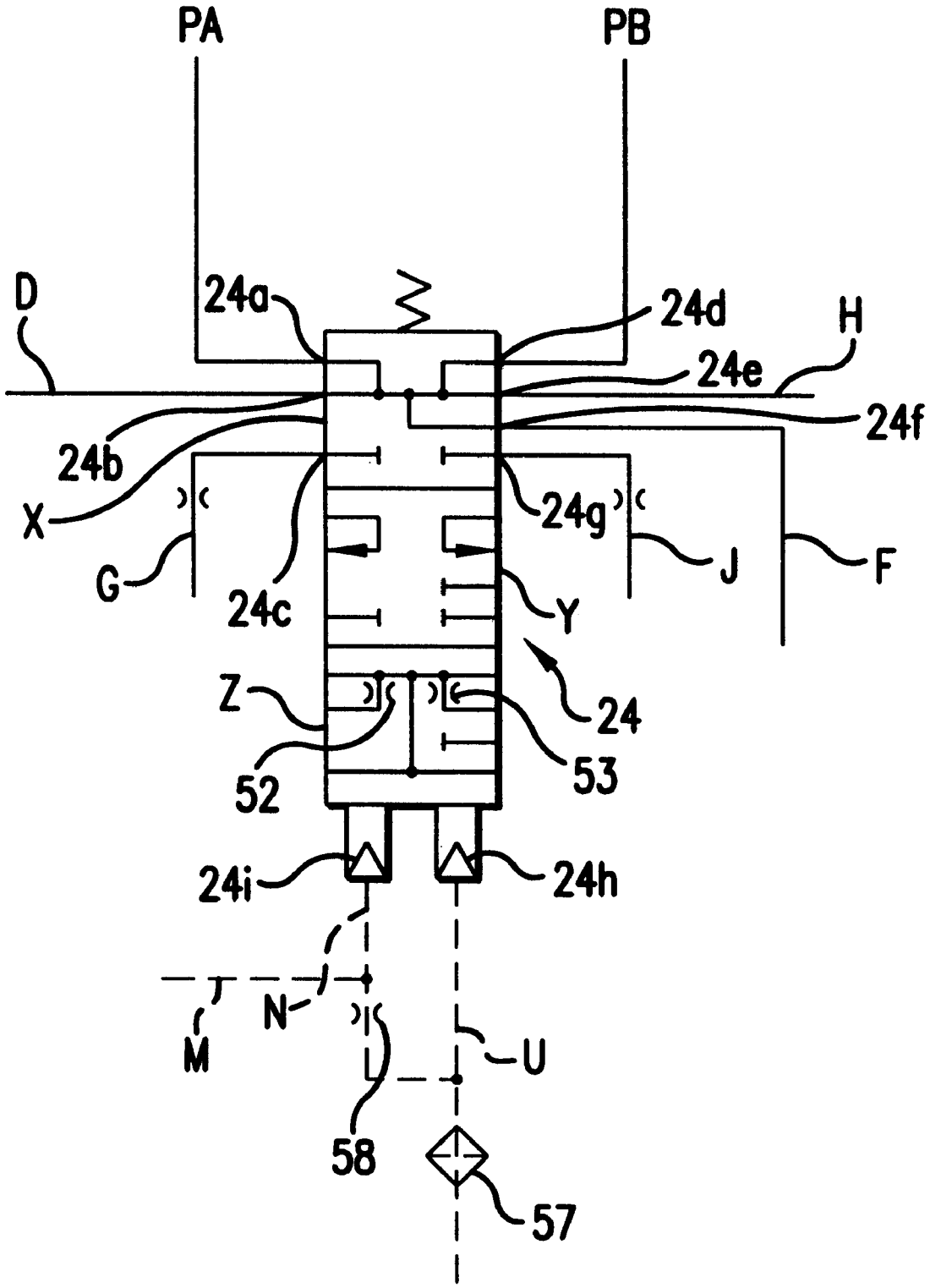
FIG. 6 is an enlarged view illustrating the connections of a second selector valve.

The first selector valve 20 is pilot-operated so that it switches between three positions according to the condition of pressurized oil feed to the first and second pilot ports 20*f* and 20*g*. A first port 20*a* (FIG. 5) connects to the third pump parallel oil line L; a second port 20*b*, the pump center bypass oil line K; a third port 20*c*, the reservoir oil line F; and a fourth port 20*d*, the reservoir oil line F. A fifth port 20*e* connects to a connection oil line Q joining an oil line that leads through a check valve 51 to the replacement attachment control valve 21 in the second pump parallel oil line J.

The first selector valve 20 is arranged so that the valve path from the first port 20*a* to the third port 20*c* and those from the second port 20*b* to the fourth and fifth ports 20*d* and 20*e* open when the selector valve is in the neutral position X which does not allow pressurized oil to be fed to the first and second pilot ports 20*f* and 20*g*. This arrangement causes pressurized oil fed from the second hydraulic pump P2 through the third pump port PC to be unloaded through the third pump parallel oil line L into the reservoir oil line F.

As described later, when in the single-flow position Y which allows pilot pressurized oil to be fed to the first pilot port 20*f*, the first selector valve 20 is arranged so that the first and third ports 20*a* and 20*c* close and that the valve path from the second port 20*b* to the fourth and fifth ports 20*d* and 20*e* open. This arrangement prevents pressurized oil flowing through the third pump parallel oil line L from being unloaded into the reservoir oil line F (that is, the unloading oil line closes) and allows pressurized oil travel along the third pump center bypass oil line K through the boom swing control valve 17, blade control valve 18, and swing control valve 19, all of which are in the neutral position X, to be unloaded into the reservoir oil line F.

When in the connection position Z that allows pilot pressurized oil to be fed to the second pilot port 20*g*, the first selector valve 20 is arranged so that the first, third, and fourth ports 20*a*, 20*c*, and 20*d* close and that the valve path from the second port 20*b* to the fifth port 20*e* opens. This arrangement prevents pressurized oil passing through the third pump parallel oil line L from being unloaded into the reservoir oil line F as described above and allows pressurized oil traveling along the third pump center bypass oil line K through the boom swing control valve 17, blade control valve 18, and swing control valve 19, all of which are in the neutral position X, to flow through the connection oil line Q to the side of the replacement attachment control valve 21.

The second selector valve 24 is pilot-operated so that it switches between three positions according to the condition of pressurized oil feed to the first and second pilots 24*h* and 24*i*. A first port 24*a* connects to the first pump port PA; a second port 24*b*, the first pump center bypass oil line D; a third port 24*c*, the first pump parallel oil line G; a fourth port 24*d*, the second pump port PB; a fifth port 24*e*, the second pump center bypass oil line H; a sixth port 24*f*, the reservoir oil line F; and a seventh port 24*g*, the second pump parallel oil line J.

The second selector valve 24 is arranged so that the third and seventh ports 24*c* and 24*g* close and that the valve paths from the first and fourth ports 24*a* and 24*d* to the second, fifth, and sixth ports 24*b*, 24*e*, and 24*f* open when the selector valve is in the neutral position X, which does not allow pilot pressurized oil to act on the first and second pilots 24*h* and 24*i*. This arrangement causes pressurized oil fed from the first and second pump ports PA and PB to be unloaded into the reservoir oil line F.

As described later, when pilot pressurized oil acts on the first pilot 24*h* only but does not act on the second pilot 24*i*, the second selector valve 24 is placed in the single-flow position Y. When in the single-flow position Y, the second selector valve is arranged so that the third, sixth, and seventh ports 24*c*, 24*f*, and 24*g* close and that the valve path from the first port 24*a* to the second port 24*b* and that from the fourth port 24*d* to the fifth port 24*e* open. This arrangement causes pressurized oil fed from the first pump port PA to flow into the first pump center bypass oil line D and pressurized oil fed from the second pump port PB to flow into the second pump center bypass oil line H.

When the pilot pressurized oil acts on the first and second pilots 24*h* and 24*i*, the second selector valve is placed in the connection position Z. When in the connection position, the second selector valve is arranged so that the sixth port 24F closes and that the valve paths from the first and fourth ports 24*a* and 24*d* to the second, third, fifth, and seventh ports 24*b*, 24*c*, 24*e*, and 24*g* open. Restrictors 52 and 53 are placed in the valve paths from the first and fourth ports 24*a* and 24*d* to the second and fifth ports 24*b* and 24*e*. The arrangement above causes pressurized oil from the first pump port PA and pressurized oil from the second pump port PB to join together at the second selector valve 24 and flow into the first pump center bypass oil line D, first pump parallel oil line G, second pump center bypass oil line H, and second pump parallel oil line J.

A pressurized oil feed circuit is described below. The embodiment is arranged to use some of pressurized oil fed from the second hydraulic pump P2. Pilot pressurized oil from the second hydraulic pump P2 is fed through a safety valve 54 and a pilot filter 55, both of which will be described later, to the pilot valves 32, 33, 34, and 35 and then from these valves to the pilot ports 19*a*, 19*b*, 22*a*, 22*b*, 25*a*, 25*b*, 26*a*, and 26*b* of the swing, arm, boom, and bucket control valves 19, 22, 25, and 26.

A first branch pilot oil line S, leading to an electromagnetic selector valve 56, described later, is formed so that the line branches from the pilot oil line R, running from the pilot filter 55 to the pilot valves 32, 33, 34, and 35. A second branch pilot oil line U, leading through the filter 57 to the first pilot 24*h* of the second selector valve 24, is formed so that the line branches from the middle of the first branch pilot oil line S. A third branch pilot oil line N, leading through a restrictor 58 to the second pilot 24*i*, is formed so that the line branches from the oil line between the filter 57 and the first pilot 24*h* in the second branch pilot oil line U. The fourth branch pilot oil line M is formed so that the line branches from the oil line between the restrictor 58 and the second pilot 24*i* in the third branch pilot oil line N.

The safety valve 54 is a two position selector valve switched by the operation of a safety lever 54*d*, installed at the operator's seat. The first port 54*a* connects to the second hydraulic pump P2; the second port 54*b*, the oil reservoir T; and the third port 54*c*, the pilot filter 55.

When the safety lever 54*d* is in the locked position, the safety valve 54 is also in the locked position which causes the first port 54*a* to close and the valve path from the third port 54*c* to the second port 54*b* to open. When in the locked position, the safety valve shuts off pilot pressurized oil from the second hydraulic pump P2, thus preventing pilot pressurized oil from being fed to the pilot oil line R and the first, second, third, and fourth branch pilot oil lines S, U, N, and M.

When the safety lever 54*d* is in the unlocked position, the safety valve 54 is also in the unlocked position which causes the second port 54*b* to close and the valve path from the first port 54*a* to the third port 54*c* to open. When the safety valve is in the unlocked position, pilot pressurized oil from the second hydraulic pump P2 is fed to the pilot oil line R and the first, second, third, and fourth branch pilot oil lines S, U, N, and M.

The electromagnetic selector valve 56 is a two position selector valve. A first port 56*a* connects to the first branch pilot oil line S; a second port 56*b*, the oil reservoir T; and a third port 56*c*, the first pilot port 20*f* of the first selector valve 20; and a fourth port 56*d*, the second pilot port 20*g* of the first selector valve 20.

The solenoid 56*e* of the electromagnetic selector valve 56 electrically connects to the operating lever 21*a* for the replacement attachment control valve 21 (or to a control unit connected to the replacement attachment control valve 21 or to the replacement attachment control valve 21 itself). The electromagnetic selector valve 56 is arranged so that it is placed in the single-flow position Y which causes the valve path from the first port 56*a* to the third port 56*c* and that from the fourth port 56*d* to the second port 56*b* to open when the operating lever 21*a* is not in use; that is, the replacement attachment control valve 21 is in the neutral position X. When the electromagnetic selector valve is in the single-flow position Y, pilot pressurized oil from the first branch pilot oil line S is fed to the first pilot port 20*f* of the first selector valve 20. Thus the first selector valve 20 is placed in the single-flow position Y as described above.

The electromagnetic selector valve 56 is also arranged so that the valve is placed in the connection position Z which causes the valve path from the first port 56*a* to the fourth port 56*d* and that from the third port 56*c* to the second port 56*b* to open when the operating lever 21*a* is in use; that is, the replacement attachment control valve 21 is in the pressurized oil feed position Y or Z. When the electromagnetic selector valve is in the connection position, pilot pressurized oil from the first branch pilot oil line S is fed to the second pilot port 20*g* of the first selector valve 20. Thus the first selector valve 20 is placed in the connection position Z as described above.

Below is described pilot pressurized oil acting on the pilots 24*h* and 24*i* of the second selector valve 24. As described above, pilot pressurized oil is not fed to the second, third, or fourth branch pilot oil lines U, N, and M when the safety valve 54 is in the locked position. This, in turn, means that pilot pressurized oil acts neither on the first pilot 24*h* nor on the second pilot 24*i*, so that the second selector valve 24 is placed in the neutral position X as described above.

The safety valve 54 switching to the unlocked position causes pilot pressurized oil to be fed to the second, third, and fourth branch pilot oil lines U, N, and M. When pilot pressurized oil is fed to the branch pilot oil lines and the fourth branch pilot oil line M is open, that is, the boom control valve 25, bucket control valve 26, and arm control valve 22 are in the neutral position X, pilot pressurized oil acts on the first pilot 24*h* due to the restricting effect of the restrictor 58 downstream of the first pilot, but does not on the second pilot 24*i*. Thus the second selector valve 24 is placed in the single-flow position Y as described above.

When pilot pressurized oil is fed to the second, third, and fourth branch pilot oil lines U, N, and M and the fourth branch pilot oil line M is closed, that is, when the left travel control valve 23L is in the pressurized oil feed position Y or Z and at least one of the boom, bucket, and arm control valves 25, 26, and 22 is in the pressurized oil feed position Y or Z, pilot pressurized oil acts on both first and second pilots 24*h* and 24*i*, so that the second selector valve 24 is placed in the connection position Z as described above.

For the arrangements described above, when the hydraulic actuators installed in the hydraulic shovel 1 need to be locked, for example, the operator leaves the operator's seat, he places the safety valve 54 in the locked position, using the safety lever 54*d*. When the safety valve is in the locked position, no pilot pressurized oil is fed to the pilot oil line R or the first, second, third, and fourth branch pilot oil lines S, U, N, and M, as described above. Thus pilot pressurized oil is not fed to the pilot port 19*a*, 19*b*, 22*a*, 22*b*, 25*a*, 25*b*, 26*a*, or 26*b* even though the pilot valves 32, 33, 34, and 35 are switched using the operating levers 30 and 31. This leads the swing, arm, boom, and bucket control valves 19, 22, 25, and 26, which are pilot-operated, not to switch from the neutral position X to the pressurized oil feed position Y or Z, so that the swing motor 6, arm cylinder 11, boom cylinder 9, or bucket cylinder 13 does not operate.

When pilot pressurized oil is not fed to the pilot oil lines, it is not fed to the pilot ports 20*f* and 20*g* of the first selector valve 20 or the pilots 24*h* and 24*i* of the second selector valve 24, either, so that the first and second selector valves 20, 24 are both placed in the neutral position X.

When the first and second selector valves 20, 24 are in the neutral position X, pressurized oil fed from the second hydraulic pump P2 through the third pump port PC is unloaded through the first selector valve 20 into the reservoir oil line F, as described above. Pressurized oil fed from the first hydraulic pump P1 through the first and second pump ports PA and PB is also unloaded through the second selector valve 24 into the reservoir oil line F. Thus pilot pressurized oil is not fed to the boom swing cylinder 9, blade cylinder 15, replacement attachment, or right and left travel motors 5R and 5L even though the manual control valves 17, 18, 21, 23L, and 23R are switched to the pressurized oil feed position Y or Z using the boom swing, blade, replacement attachment, and right and left travel operating levers 17*a*, 18*a*, 21*a*, 23La, and 23Ra. This means that the hydraulic actuators 9, 15, 5L and SR do not operate.

To unlock a hydraulic actuator, that is, use an operating lever for operating its corresponding hydraulic actuator, the safety valve 54 is switched to the unlocked position using the safety lever 54*d*. When the safety valve is in the unlocked position, pilot pressurized oil is fed to the pilot oil line R and the first, second, third, and fourth branch pilot oil lines S, U, N, and M. That is, using the operating levers 30 and 31 causes the pilot valves 32, 33, 34, and 35 to switch from one position to another. Thus pilot pressurized oil is fed to the pilot ports 19*a*, 19*b*, 22*a*, 22*b*, 25*a*, 25*b*, 26*a*, and 26*b*, so that the swing, arm, boom, and bucket control valves, which are pilot-operated, switch from the neutral position X to the pressurized oil feed position Y or Z.

When pressurized oil is fed to the pilot oil lines, it is also fed to the pilot ports 20*f* and 20*g* of the first selector valve 20 and the pilot ports 24*h* and 24*i* of the second selector valve 24. When the replacement attachment operating lever 21*a* is not in use, pilot pressurized oil is fed from the first branch pilot oil line S through the electromagnetic selector valve 56, which is in the single-flow position Y, to the first pilot port 20*f*, so that the first selector valve 20 is placed in the single-flow position Y. When the first selector valve is in the single-flow position, pressurized oil fed from the second hydraulic pump P2 through the third pump port PC is further fed through the control valves 17, 18, and 19, which have been switched to the pressurized oil feed position Y or Z using the boom swing, blade, and swing operating levers 17*a*, 18*a*, and 30, to hydraulic actuators, that is, the boom swing cylinder 9, blade cylinder 15, and swing motor 6. This means that using the operating levers allows the hydraulic actuators to operate.

Using the operating lever 21*a* for a replacement attachment attached to the hydraulic shovel 1 causes the electromagnetic selector valve 56 to switch to the connection position Z, thus feeding pilot pressurized oil from the first branch pilot oil line S to the second pilot port 20*g* of the first selector valve 20. As a result, the first selector valve 20 switches to the connection position Z. When at least one of the boom swing, blade, and swing operating levers 17*a*, 18*a*, and 30 is in use, with the first selector valve 20 in the connection position Z, pressurized oil is fed from the third pump center bypass oil line K and third pump parallel oil line L through the control valves 17, 18, and 19 to the boom swing cylinder 9, blade cylinder 15, and swing motor 6, so that the hydraulic actuators 9, 15, and 6 can operate. When none of the boom swing, blade, and swing operating levers 17*a*, 18*a*, and 30 is in use, pressurized oil flowing through the third pump center bypass oil line K flows into the second pump parallel oil line J, connecting to the replacement attachment control valve 21, through the control valves 17, 18, and 19, which are in the neutral position X; the first selector valve 20, which is in the connection position Z; and the connection oil line Q. This causes pressurized oil to be fed from not only the second pump parallel oil line J but the third center bypass oil line K to the replacement attachment.

When pressurized oil is fed to the pilot oil lines, with none of the boom, bucket, and arm operating levers 30 and 31 in use, pilot pressurized oil acts only on the first pilot 24*h*, as described above, so that the second selector valve 24 is placed in the single-flow position Y. When the second selector valve is in the single-flow position Y, pressurized oil fed from the first hydraulic pump P1 through the first pump port PA is further fed from the first pump center bypass oil line D through the left travel control valve 23L, which has been switched to the pressurized oil feed position Y or Z using the operating lever 23La, to the left travel motor 5L. Pressurized oil fed from the first hydraulic pump P1 through the second pump port PB, on the other hand, is further fed from the second pump center bypass oil line H and second pump parallel oil line J through the right travel and replacement attachment control valves 23R and 21, which have been switched to the pressurized oil feed position Y or Z using the operating levers 23Ra and 21*a*, to the right and left travel motors 5R and 5L and replacement attachment hydraulic actuator. This, in turn, means that using the operating levers allows the hydraulic actuators to operate. Pressurized oil from the first pump port PA is fed to the left travel motor 5L, and pressurized oil from the second pump port PB is fed to the right travel motor SR and replacement attachment hydraulic actuator; that is, pressurized oil from the two different ports PA and PB are fed to their corresponding special hydraulic actuators.

When the left travel operating lever 23La and at least one of the boom, bucket, and arm operating levers 31 and 30 are in use, pilot pressurized oil acts on both first and second pilots 24*h* and 24*i*, thus placing the second selector valve 24 in the connection position Z. When the second selector valve is in the connection position Z, pressurized oil from the first pump port PA and pressurized oil from the second pump port PB join together in the second selector valve 24, flow into the pump center bypass oil line D, first pump parallel oil line G, second pump bypass oil line H, and second pump parallel oil line J, and feed through the control valves 21, 22, 23L, 23R, 25, and 26, which have been switched to the pressurized oil feed position Y or Z using the replacement attachment, arm, right and left travel, boom, and bucket operating levers 21*a*, 30, 23Ra, 23La, and 31, into hydraulic actuators, that is, the replacement attachment hydraulic actuator, arm cylinder 11, right and left travel motors SR and 5L, boom cylinder 8, and bucket cylinder 13. This, in turn, means that using the operating levers allows the hydraulic actuators to operate. After joining together in the second selector valve 24, pressurized oil from the first pump port PA and pressurized oil from the second pump port PB are fed to the actuators as required.

As described above, in the embodiment, only switching the safety valve 54 between locked and unlocked positions allows a plurality of actuators to be locked and unlocked at the same time no matter whether the control valves controlling pressurized oil feed to the actuators are pilot-operated or operated by other means. This increases hydraulic actuator operability. Moreover, the present invention eliminates the need for locking devices for conventional control valves that are not pilot-operated, thus helping reduce hydraulic circuit cost.

In addition, the first and second selector valves 20 and 24 can not only switch between feeding pressurized oil from the hydraulic pumps P1 and P2 to the hydraulic actuators and unloading the oil to the side of the oil reservoir T but join together a pump oil line from one of the hydraulic pumps and a pump oil line from the other. This means that one selector valve has two functions, thus reducing the number of parts in a hydraulic circuit and cutting hydraulic circuit cost.

Figure 2:
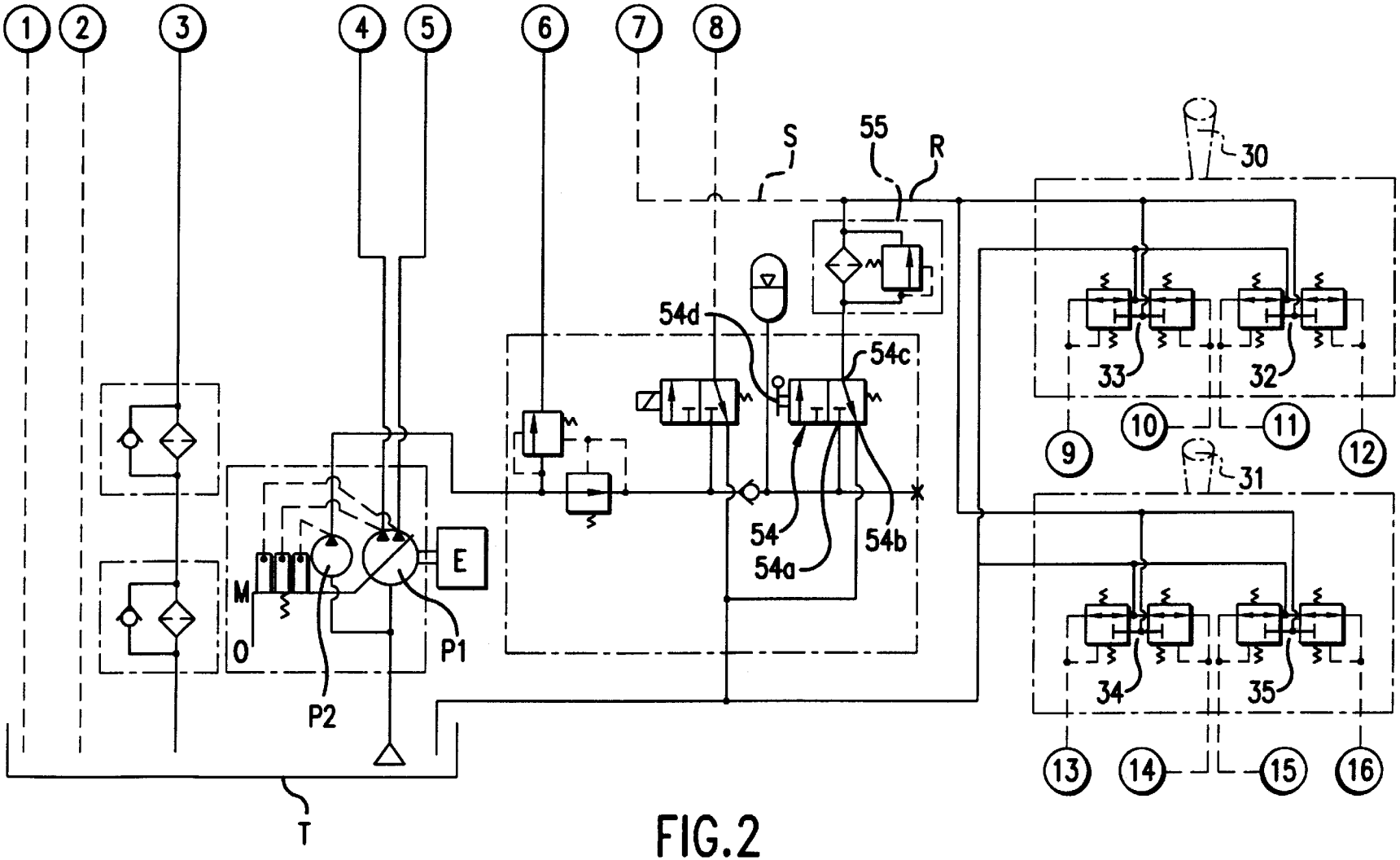
FIG. 2 is a diagram of part of a hydraulic circuit for a hydraulic shovel.
Figure 3A:
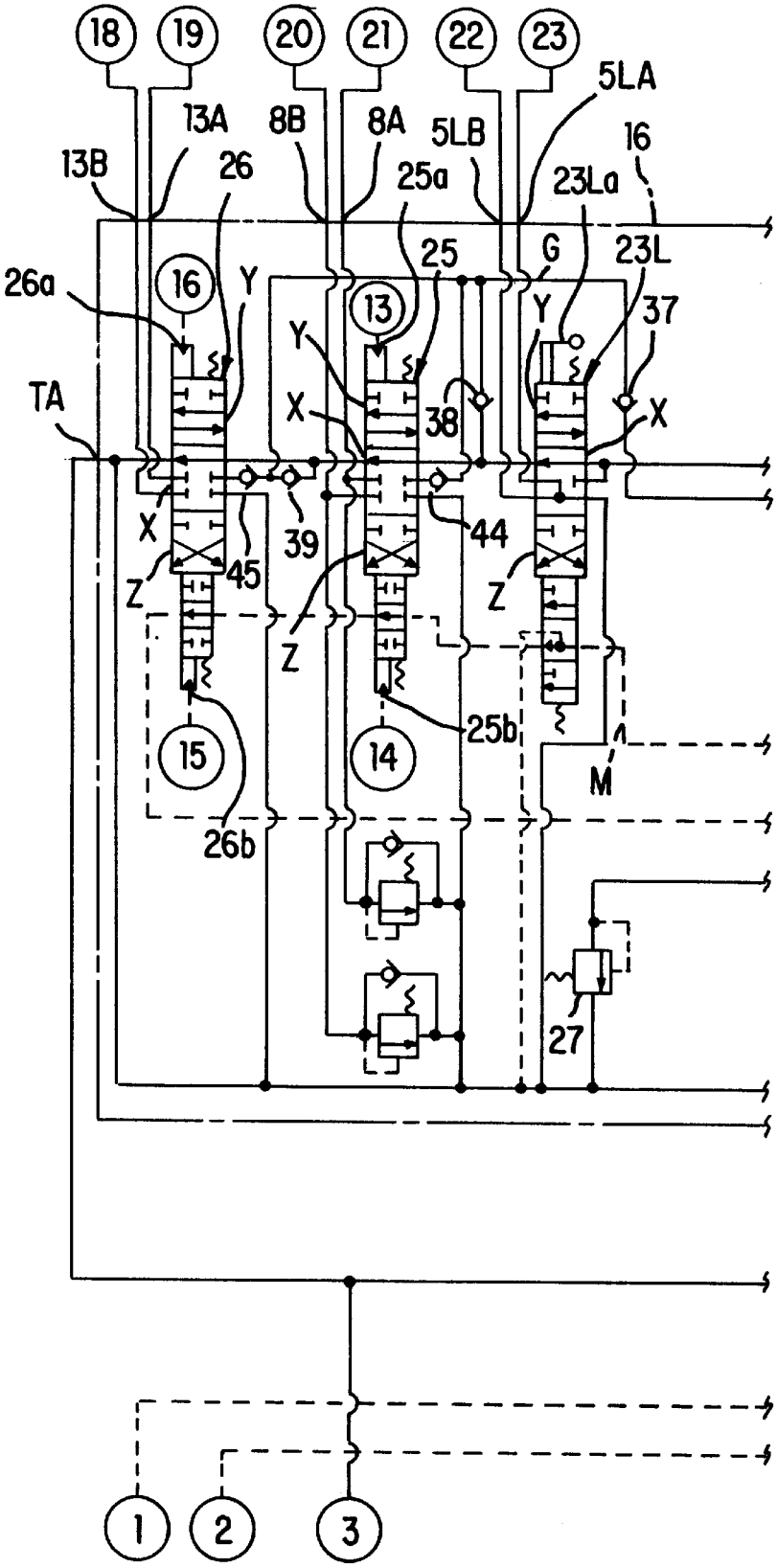
FIG. 3 is a diagram of another part of the hydraulic circuit for a hydraulic shovel.
Figure 3B:
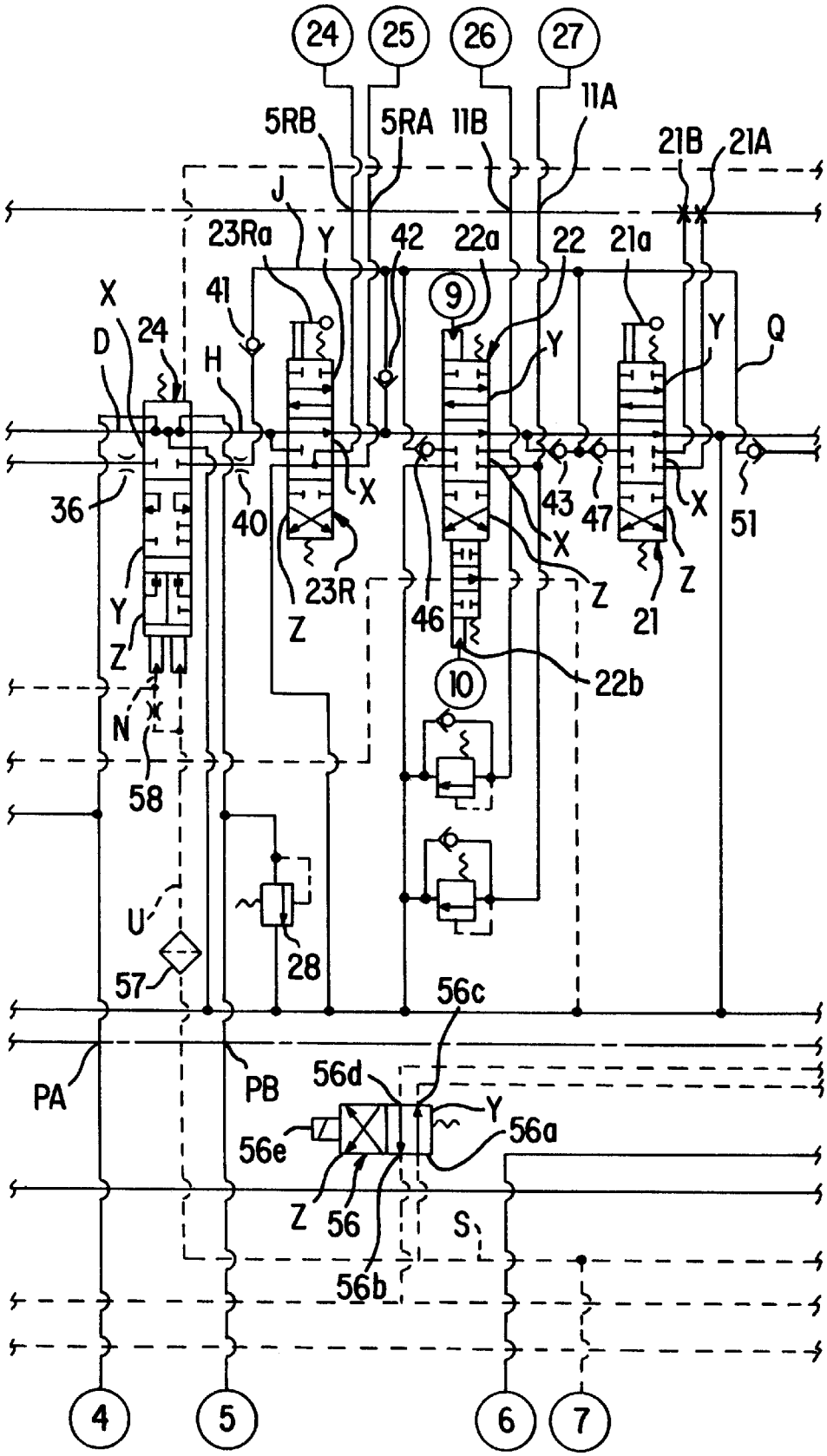
Figure 3C:
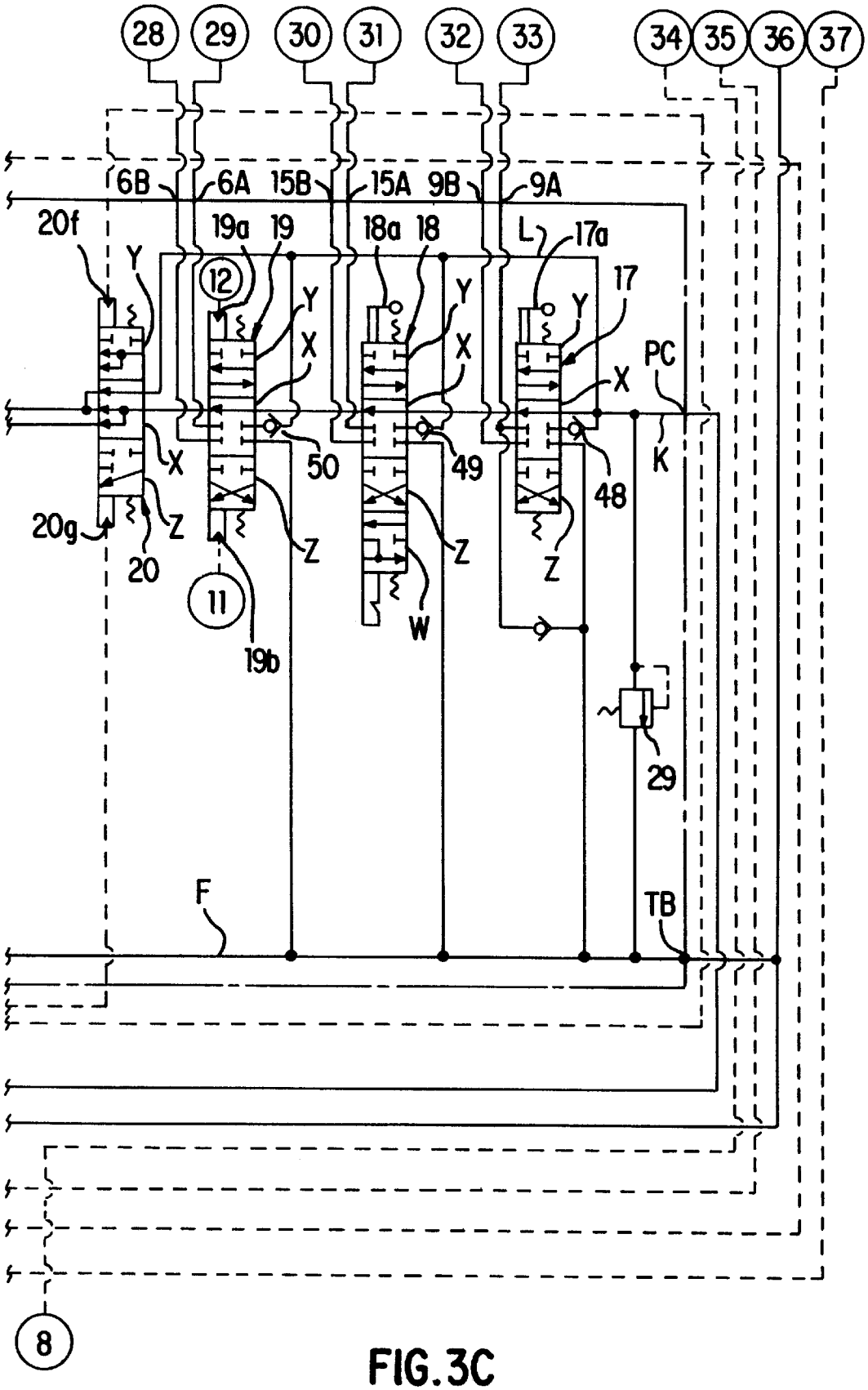
Figure 4:
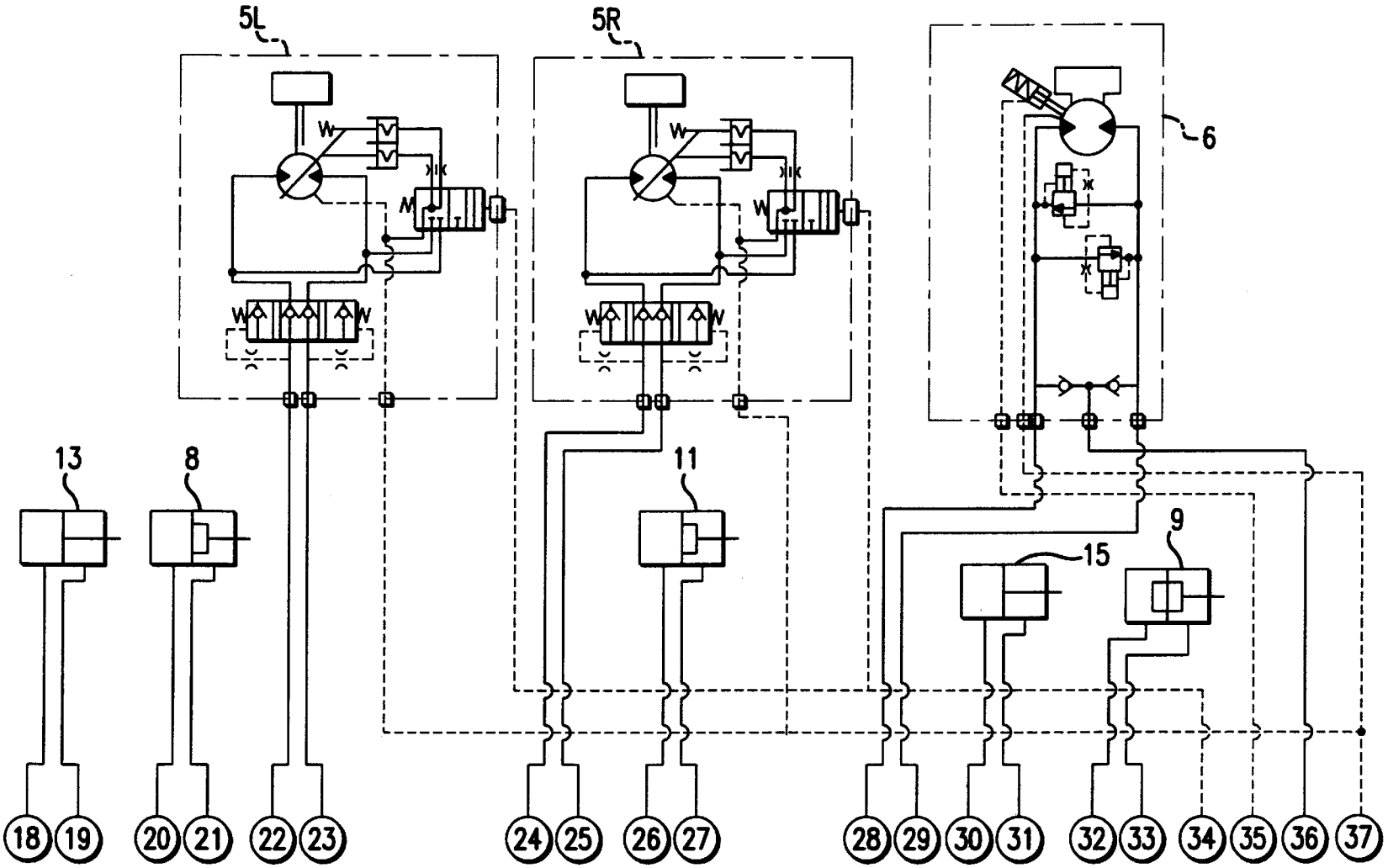
FIG. 4 is a diagram of still another part of the hydraulic circuit for a hydraulic shovel.

In FIGS. 1, 2, and 3, the items with the same circled numbers are connected together.

Industrial Applicability

The present invention is industrially applicable in terms of the following advantages.

A first embodiment enables hydraulic actuators to be locked at the same time by stopping pressurized oil feed to the actuators by opening unloading oil lines, which advantage eliminates the need for troublesome locking of individual hydraulic actuators.

A second embodiment enables hydraulic actuators to be locked at the same time. Since pilot pressurized oil switches the unloading oil line selector valve, only stopping pilot pressurized oil feed causes the actuators to be locked, and the hydraulic circuit is simple.

When the second embodiment referred to above is rearranged a third embodiment. The third embodiment prevents the control valves from being switched to the pressurized oil feed position and the unloading oil line selector valve from being switched to the closed position by closing the pilot oil line on-off valves, so that a plurality of hydraulic actuators can be locked at the same time.

Features of the first three embodiments can be arranged as a fourth embodiment to enable the unloading oil line selector valve not only to open or close the unloading oil line but to join together pressurized oil from one of the pressurized oil sources and pressurized oil from the other. Thus the unloading oil line selector switch has two functions in the hydraulic circuit, thus helping simplify hydraulic circuit arrangement.

The fourth embodiment can be further modified to create a fifth embodiment that favorably enables an additional hydraulic actuator besides the plurality of hydraulic actuators to be fed with pressurized oil when the plurality of hydraulic actuators are not fed with pressurized oil.

We claim:

1. A hydraulic circuit for hydraulic equipment, said circuit comprising:

a first pressurized oil source, a plurality of control valves, and a plurality of hydraulic actuators;

said first pressurized oil source being connected through each of said control valves to a corresponding hydraulic actuator of said plurality of actuators;

an unloading oil line connected upstream of said control valves;

an unloading oil line selector valve for selectively connecting said unloading oil line with an oil reservoir, thereby diverting pressurized oil from said first pressurized oil source to said oil reservoir such that pressure in said unloading oil line is equal to pressure in said oil reservoir and preventing pressurized oil from feeding through said control valves to said hydraulic actuators; and a safety valve controlling said unloading oil line selector valve unloading oil line selector valve without controlling volume of flow through said selector valve.

2. The hydraulic circuit for hydraulic equipment according to claim 1, wherein there is provided a second pressurized oil source, and an additional control valve that controls pressurized oil from said second pressurized oil source to an additional hydraulic actuator, and wherein the unloading oil line selector valve has a connection position which connects the first pressurized oil source to the additional control valve, to join together pressurized oil from said first pressurized source and second pressurized source.

3. The hydraulic circuit for hydraulic equipment according to claim 2, wherein an oil line from the first pressurized oil source for operating the plurality of hydraulic actuators to the unloading oil line selector valve is formed so that the oil line passes through at least one control valve of said plurality of control values which is in a neutral position so it does not allow pressurized oil to be fed to its corresponding hydraulic actuator.

4. A hydraulic circuit for hydraulic equipment, said circuit comprising:

a first pressurized oil source, a plurality of control valves, including a first set of control valves and a second set of control valves;

pilot pressure controlling means for actuating said first set of control valves;

non-pilot pressure controlling means for actuating said second set of control valves;

a plurality of hydraulic actuators, said first pressurized oil source being connected through each of said control valves to a corresponding hydraulic actuator of said plurality of actuators;

a source of pilot pressurized oil;

a pilot oil line connected to said pilot pressure controlling means;

an unloading oil line connected upstream of at least said second set of control valves;

an unloading oil line selector valve for selectively connecting said unloading oil line with an oil reservoir, thereby diverting pressurized oil from said first pressurized oil source to said oil reservoir and preventing pressurized oil from feeding through at least said second set of control valves to their corresponding hydraulic actuators, said pilot oil line being connected to said unloading oil line selector valve;

a safety locking means for controlling said unloading oil line selector valve, said safety locking means including a pilot oil line selector valve connected between said source of pilot pressurized oil and said pilot oil line, said pilot oil line selector valve selectively connecting said pilot oil line to said source of pilot pressurized oil; wherein said unloading oil line selector valve is disconnected from said oil reservoir, by feeding pilot pressurized oil from said source of pilot pressurized oil through said pilot oil line to said unloading oil line selector valve.

5. The hydraulic circuit for hydraulic equipment according to claim 4, wherein said pilot pressure controlling means is disconnected from said source of pilot pressurized oil, preventing said first set of control valves from being switched to a pressurized oil feed position, when said pilot oil line selector valve disconnects said source of pilot pressurized oil from said pilot oil line.

6. The hydraulic circuit for hydraulic equipment according to claim 4, wherein there is a second pressurized oil source, and an additional control valve which controls pressurized oil from said second pressurized oil source to an additional hydraulic actuator; and wherein the unloading oil line selector valve has a connection position which connects the first pressurized oil source to said additional control valve, to join together pressurized oil from said first and second pressurized source.

* * * * *